United States Patent [19]

Barkus

[11] Patent Number: 4,637,677

[45] Date of Patent: Jan. 20, 1987

[54] ELECTRICAL CONNECTOR

[75] Inventor: Lee A. Barkus, Millersburg, Pa.

[73] Assignee: AMP Incorporated, Harrisburg, Pa.

[21] Appl. No.: 683,082

[22] Filed: Dec. 18, 1984

[51] Int. Cl.[4] ..... H01R 4/52

[52] U.S. Cl. ..... 339/274; 339/204; 339/255 R

[58] Field of Search ..... 339/204, 205, 210 R, 339/210 M, 255 R, 255 L, 273 S, 273 R, 273 F, 274, 276 S, 276 SF

[56] References Cited

U.S. PATENT DOCUMENTS

| | | | |
|---|---|---|---|
| 3,579,283 | 5/1971 | Welburn | 339/274 |
| 3,686,622 | 8/1972 | Bonhomme | 339/274 |
| 3,999,829 | 12/1976 | Glaesel | 339/274 |

OTHER PUBLICATIONS

I.B.M. Technical Disclosure Bulletin, vol. 6, No. 3, Aug. 1963, by R. L. Agaud, L. Z. Carpenter & W. M. Clark.

*Primary Examiner*—Gil Weidenfeld
*Assistant Examiner*—Thomas M. Kline
*Attorney, Agent, or Firm*—Allan B. Osborne

[57] ABSTRACT

An electrical connector for electrically interconnecting flat terminals known as tabs. The contact units are loosely positioned in a housing but yet preloaded to provide wiping action on the inserting tabs terminals. The spring members of the contact units provide two stage insertion forces with the first stage being a low force and the second stage substantially higher.

16 Claims, 5 Drawing Figures

ELECTRICAL CONNECTOR

U.S. Pat. No. 4,453,792 discloses a connector for joining high current-carrying devices, such as bus bars, used in computer mainframes and the like. The connector includes a housing with cavities for contact units which consist of two elongated, parallel blades or plates held together by spring members clipped onto each side. Tab-like terminals, e.g., bus bars, enter between the blades from each end and are retained therein by the now-loaded spring members compressing the blades against the terminals. The contact units are loosely confined in the cavities so as to accept misaligned terminals.

U.S. Pat. No. 4,423,917 discloses a connector for receiving two tab terminals, one from each end, which may be misaligned relative to the connector and to each other. This connector includes several units, positioned side-by-side and having tab terminal receiving receptacles at each end. The units are mounted intermediate each end for both rotational and vertical movement to receive misaligned tab terminals.

It is a purpose of the present invention to provide a connector supplying a compact, redundant electrical path for high current in particular and to accommodate mismatch of inserted tab terminals with at least an acceptable minimal contact force.

An electrical connector as defined in the foregoing paragraph is, according to the present invention, characterized by a conductor having convex end surfaces and a spring member attached to the center with ends extending perpendicularly away therefrom. The conductor is positioned diagonally in a housing having slots on opposed side walls adjacent top and bottom walls. The convex surfaces, in cooperation with the top and bottom walls, define tab receptacles. The ends of the spring member bear against the cavity walls to resiliently support the conductor and provide a pivoting point for the conductor at the point of attachment therewith.

For a better understanding of the invention, a description of an embodiment thereof will now be given with reference to the accompanying drawings, in which.

Figure 1:
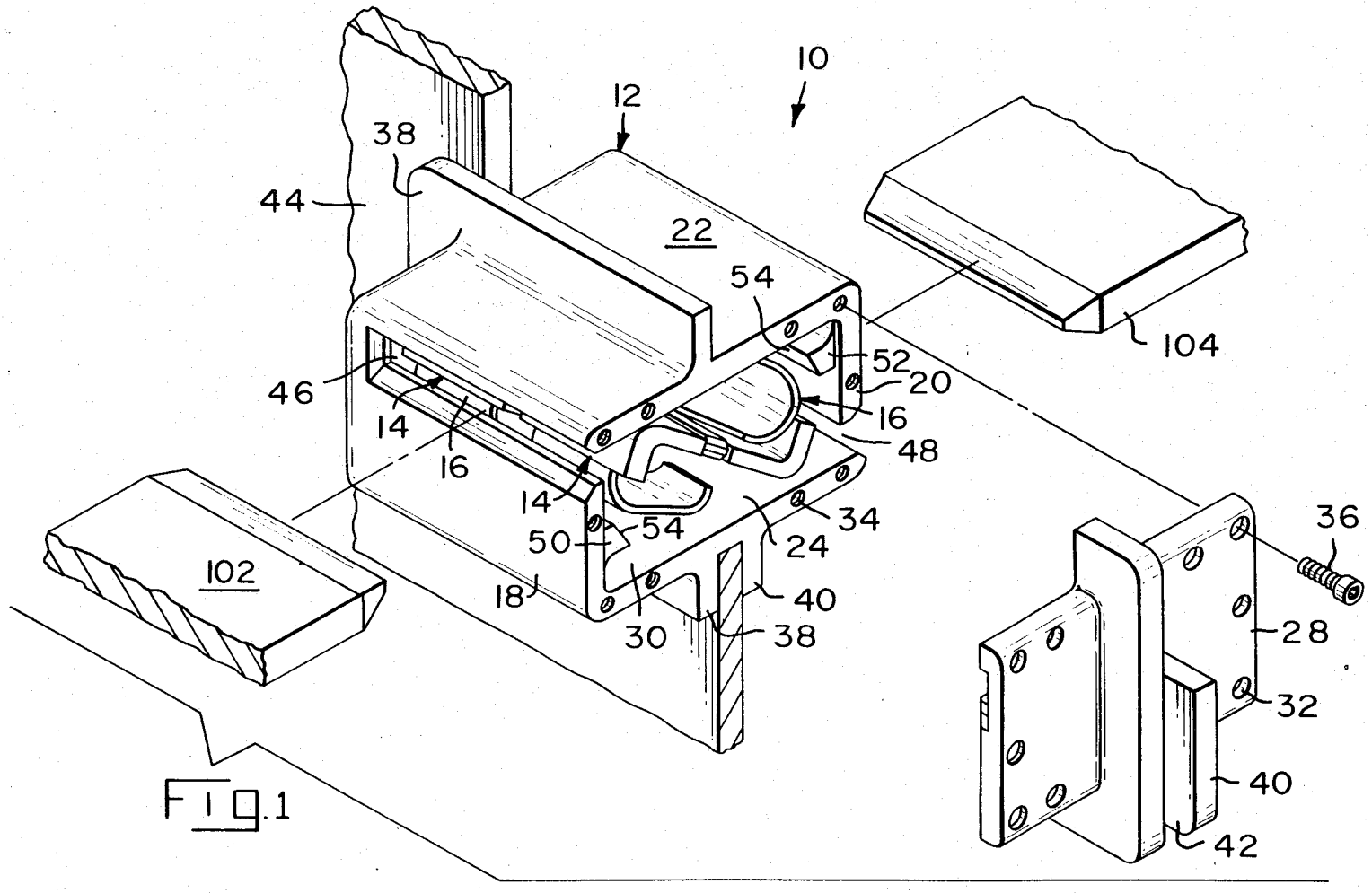
FIG. 1 is an isometric view of the electrical connector of the present invention with one end wall removed.

Directing the reader's attention first to FIG. 1, electrical connector 10 has three major components: housing 12, conductor 14 and spring member 16 with the latter two components forming a contact unit of which there are two within housing 12. The two units provide redundant electrical paths and, accordingly, is preferred. However, the concept of the present invention is fully met in an embodiment having a single contact unit of appropriate dimensions in the housing.

Housing 12 preferably is molded, a suitable material being a polycarbonate such as sold by General Electric under the tradename NORYL N-300.

Housing 12 includes opposing left end wall 18 and right end wall 20, top wall 22 and bottom wall 24, the latter two walls extending between and joining the opposing end walls 18 and 20. Side wall 26 (not visible in FIG. 1 but seen in FIG. 4) and side wall 28 complete the housing wall structure. Side wall 28 is molded as a separate entity and secured to the housing after conductors 14 and spring members 16 are placed in cavity 30 which is defined by the walls.

The side wall 28 is shown with holes 32 which are in alignment with threaded apertures 34 in the edges of walls 18 to 24. Machine screws 36, received in apertures 34, secure the side wall 28 to complete the housing assembly. This method provides subsequent access to the cavity if necessary. A more permanent securing would have pins (not shown) molded to and extending away from the edges of walls 18 to 24 in place of threaded apertures 34. After sliding the side wall onto the pins, the free ends would be flattened out to rivet that wall onto the other walls.

A flange, indicated by reference numeral 38, encircles housing 12, being located between end walls 18 and 20. A second flange 40, spaced from flange 38 to define groove 42 (seen on side wall 28), encircles the lower portion of the housing. These flanges and groove provide a means for mounting connector 10, e.g., on a computer mainframe, a wall of which is partially shown and indicated by reference numeral 44.

Slot 46 is provided in end wall 18 adjacent top wall 22. Similarly, slot 48 is provided in end wall 20 adjacent bottom wall 24. These offsetting slots give access to cavity 30.

Figure 4:
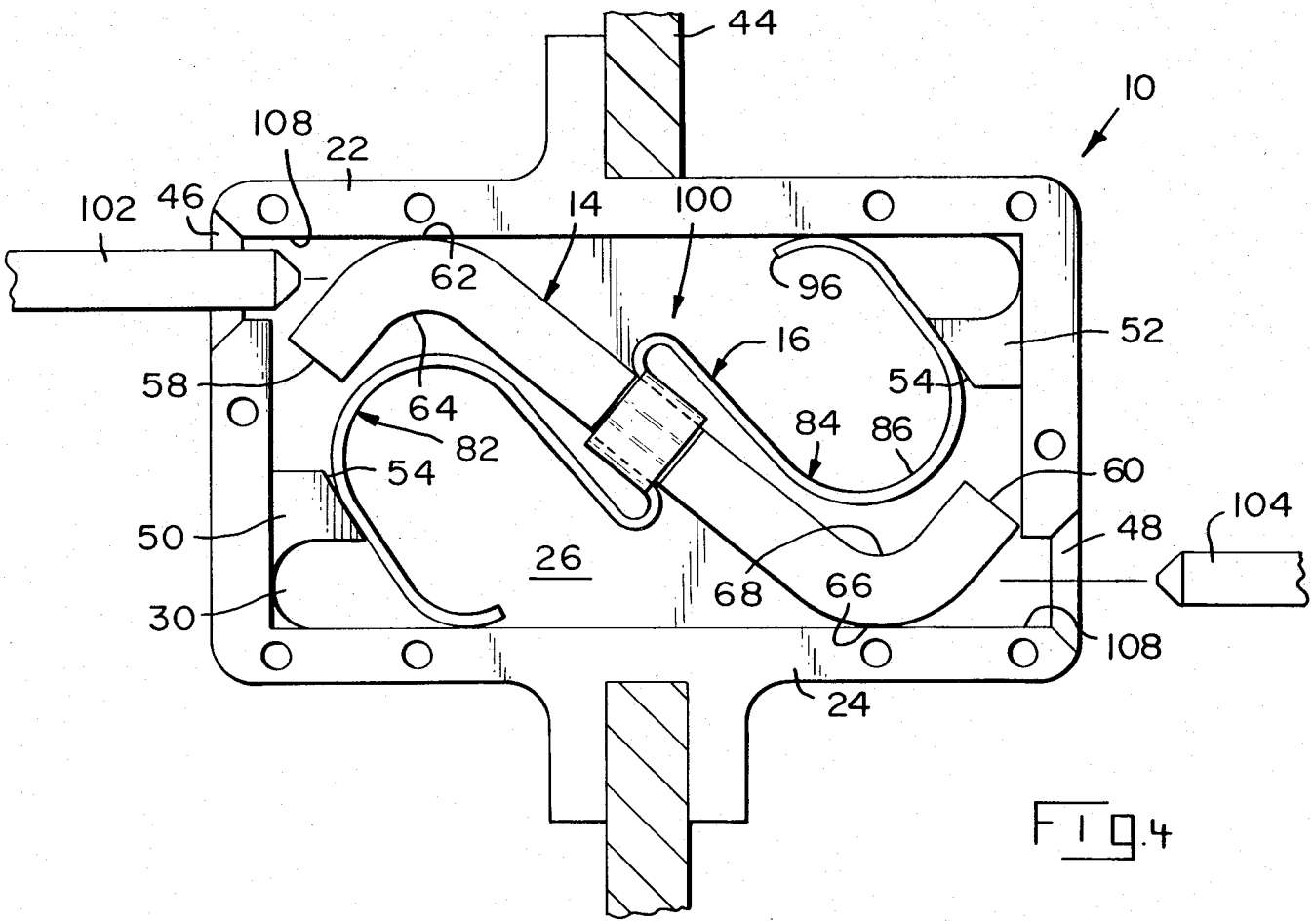
FIGS. 4 and 5 are views looking into an end of the connector of FIG. 1 showing before and after tabs are inserted thereinto respectively.

There are two support bars 50 and 52 within cavity 30, bar 50 being on the inside surface of end wall 18 and bar 52 being on the inside surface of opposing end wall 20. The bars extend across the length of the end walls, i.e., from near side wall 26 to near side wall 28. Bar 50 is located between slot 46 and bottom wall 24 while bar 52 is between slot 48 and top wall 22. The surface of each bar which faces into the cavity, indicated by reference number 54, is slanted with the surface on bar 50 facing obliquely towards top wall 22 and the surface on bar 52 facing obliquely towards bottom wall 24. FIG. 4 shows this particular structure quite well.

Figure 2:
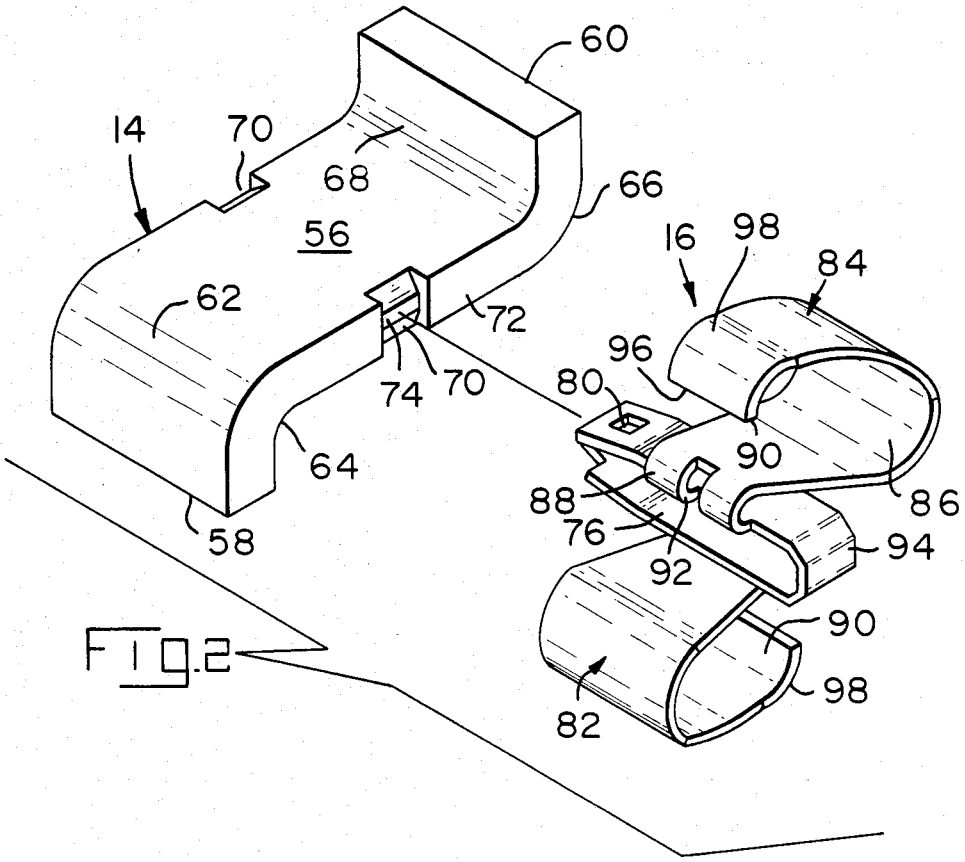
FIG. 2 is an isometric view of the conductor and spring member seen in the housing cavity of the connector in FIG. 1.

The second and third components of connector 10, conductor 14 and spring member 16 respectively are shown separated, one from the other, in FIG. 2 to which attention is now directed.

Conductor 14 is an elongated, S-shaped bar, preferably of copper and plated with silver, and has a width and thickness commensurate with the anticipated highest current which is to flow therethrough. The length, also a function of such current usage, dictates the size of cavity 30 and spring member 16.

The bar includes straight section 56 and turned-out ends 58 and 60. Each end points in a direction opposite the other end. The bending provides convex surface 62 and concave surface 64 at end 58 and convex surface 66 and concave surface 68 at end 60. The two convex surfaces are on opposite sides of the bar as are the two concave surfaces.

Notches 70 are located in each side 72 of section 56 and are at the longitudinal center of the bar, i.e., midway between ends 58 and 60. The floor 74 of each notch is angularly convex. These notches provide a means for locating and holding spring member 16 on conductor 14.

Figure 3:
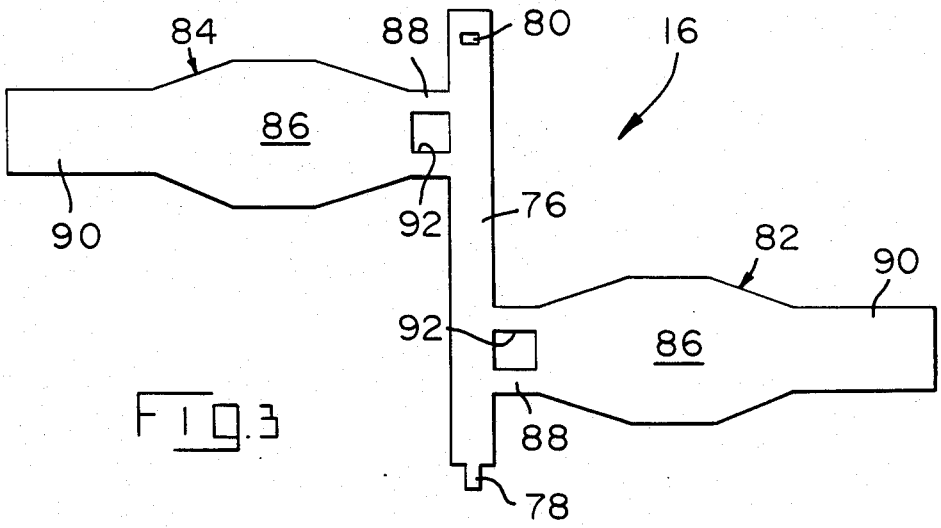
FIG. 3 is a view of the blanked-out spring member prior to being formed.

Spring member 16 is preferably stamped and formed from a material such as stainless steel. FIG. 3, to which reference is now made, shows a blanked-out spring member prior to forming. A centrally disposed strap 76 has a stub 78 at one end and hole 80 at the other end. Spring blade 82 is attached to one side of the strap near stub 78 and spring blade 84 is attached to the opposite side of the strap near hole 80. Each spring blade includes wide midsection 86, narrower attachment section 88 and narrower end section 90. The changes in widths between sections are gradual rather than abrupt. The greater width of midsection 86 provides a higher normal force. Opening 92 in each section 88 allows for low initial force/deflection without sacrificing the stability of the spring. As will be noted further on, this structure also predetermines the stages of deflection.

Referring now to both FIGS. 2 and 3, spring member 16 is formed by folding strap 76 into a band with the closed end 94 being angular and with stub 78 being adjacent hole 80 and, further, by triple bending or folding each spring blade. The first bend is across the attachment section 88. This bend wraps the blade back over strap 76 to extend away therefrom in a direction opposite to the attachment side. The second bend is across the widest part of midsection 86 and it brings end section 90 back to and spaced above the strap. The third bend curves free end 96 of end section 90 in to point towards the strap. This bend provides convex surface 98. The second bend is a gradual one and gives the blade a somewhat oval shape.

Spring member 16 is attached to conductor 14 by placing strap 76 around section 56 and in notches 70. The angular closed end 94 is conformably received on angular floor 74. The angularity helps to keep spring member 16 from slipping laterally while the walls defining the notches keep it from moving longitudinally. The strap is latched by threading stud 78 in hole 80 and bending it back over.

The positioning of the spring member on the conductor places midsection 86 on blade 82 facing concave surface 64 and midsection 86 on blade 84 facing concave surface 68. This arrangement is shown in FIG. 4 to which attention is now directed.

FIG. 4 illustrates the positioning of conductor 14 with attached spring member 16, hereinafter referred to as contact unit 100, in cavity 30. The unit is, in effect, floating therein with some minimal support being provided by the spring blades, slightly compressed, pushing convex surface 62 against top wall 22 and convex surface 66 against bottom wall 24. The spring blades are confined and held in compression by bars 50 and 52 and walls 22 and 24. The degree of compression is minimal to keep convex surfaces 62 and 66 generally in line with slots 46 and 48 respectively and, more importantly, to preload those convex surfaces against the respective wall to provide wipe as the tabs are inserted.

FIG. 4 also shows tab 102 just inserted into slot 46 and tab 104 in line with but still remote from slot 48. These tabs, as can be seen in FIG. 1, are heavy, thick tabs used in high current applications.

Figure 5:
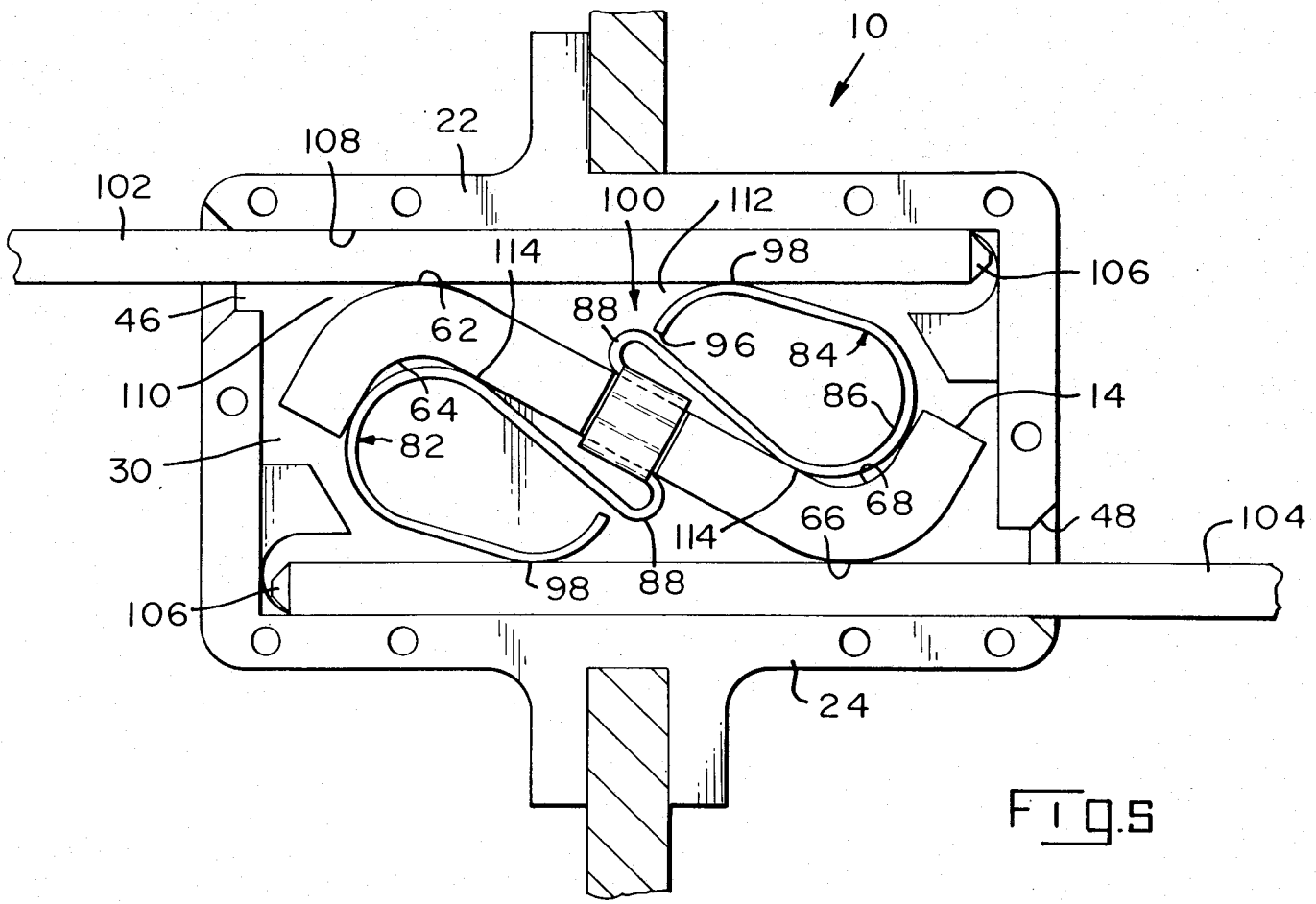

Tabs 102 and 104 have been fully inserted into cavity 30 in the drawing of FIG. 5. As each tab enters through its respective slot, the beveled tip thereon, indicated by reference numeral 106, slides in between a convex surface, e.g., 62, and the inside surface 108 of the particular wall, e.g., top wall 22; i.e., the inside wall surface and convex surface cooperate to provide a receptacle 110 for the tab.

The aforementioned insertion pivots contact unit 100 counterclockwise (vis-a-vis FIG. 5). The blades on the spring member, and more particularly, the convex surfaces 98 thereon, slide along the inside surfaces 108 of walls 22 to 24 to point free ends 96 towards the conductor. This provides an entrance to a second receptacle 112 defined by the inner surface 108 and convex surface 98 on a blade. The sliding also begins the deflection and compression of the spring blade. The first low force deflection occurs at the weakest section which is attachment section 88. The spring blade rotates clockwise until contact is made at point 114 on the straight section 56 near a concave surface on the conductor. The compressive forces being exerted on the conductor at this point are transferred to the tab or surface 108 abutting the convex surface opposite thereto. The second stage deflection is at midsection 86. Being less yielding due to its greater width, more force is required. Also, more force is required because the spring blades are already somewhat compressed. Accordingly, while the tab 102 entered receptacle 110 under a low insertion force, a higher force is required to drive it deeper into the second receptacle 112. Under this higher force, midsection 86 is deflected into a tighter radius so that the blades become elongated. The elongation stops when the outer surface of the midsections meet concave surfaces 64 and 68 on the conductor. This second stage begins when one tab is inserted and is completed after insertion of the second tab. The blades are now fully compressed so that the tabs are experiencing the total normal forces the spring blades are capable of generating.

The disclosed structure provides that each tab experiences two compressive forces on it (per contact unit), the first being the convex surface (62 or 66) on the conductor (receptacle 110) and the second being the convex surface 98 on the blades 82 or 84 (receptacle 112). The walls 22 and 24 provide the stationary support against which the tabs are being pushed.

The low insertion first stage deflection and compression occurring as the front end of the tabs pass through the first receptacle provides wiping of the tab against the convex surface on the conductor to clean dirt and debris from the engaging surfaces.

In summary, each set of convex surfaces (62, 98) (66, 98) are on planes spaced one from the other. As the tabs are inserted, the space therebetween decreases and the normal force against the tabs increase.

The double contact units provide redundancy as noted above; that is, each unit is capable of carrying the current load separately in the event of failure of one receptacle.

The structure disclosed yields minimum current path therethrough. Further, with the contact unit being somewhat floating within the cavity, a certain amount of tab mismatch can be accommodated.

What is claimed is:

1. An electrical connector, comprising:

a housing with a cavity therein and with a slot located in each of two opposing walls providing access to the cavity, one slot being parallel to and adjacent a top wall of the housing and the second slot being parallel to and adjacent a bottom wall of the housing;

an elongated conductor having a convex surface at each end with one convex surface facing a direction opposite to that of the other convex surface; and a spring member attached to the conductor intermediate the ends thereof and having a spring blade with a convex surface extending from opposite surfaces of the conductor;

said conductor and attached spring member being positioned in the cavity so that the convex surface on each end of the conductor and on each spring blade are in line with a slot and are adjacent respectively a top and bottom wall to form therewith first and second receptacles in line with each other for receiving a tab inserted into the slots and further with the spring blades bearing against said top or bottom walls to resiliently position and support the conductor and permit pivoting thereof about the point of attachment as said tabs engage said first receptacles.

2. The electrical connector of claim 1 wherein the conductor includes a notch on each side intermediate the ends and the spring member includes a band which encircles the conductor and is received in the notches to prevent longitudinal movement along the conductor.

3. The electrical connector of claim 2 wherein the conductor includes a concave surface adjacent each end and which face in opposite directions relative to each other, and the spring blades include a rounded midsection which is received in the concave surface when compressed.

4. The electrical connector of claim 1 wherein the spring member is stamped from a resilient material with each blade being attached to an opposite side of an elongated strap and having an attachment section with one end being attached to the strap, an end section and a midsection intermediate to and wider than the attachment and end sections.

5. The electrical connector of claim 4 wherein each spring blade is first bent back over the strap and then reversely bent into a generally oval shape as viewed from a side thereof with the end section being over and spaced from the strap.

6. The electrical connector of claim 5 wherein a hole is provided in the attachment section to reduce its resistance to flexing.

7. The electrical connector of claim 6 wherein the spring blades provide a two-stage deflection with the first stage being a deflection of the attachment section and the second stage being a deflection of the midsection.

8. The electrical connector of claim 7 wherein the force required for the first stage deflection is less than the force required for the second stage deflection.

9. An electrical connector, comprising:

a. a housing of insulating material with slots in opposing end walls accessing a cavity within the housing, said slots being offset relative to each other; and b. a contact unit positioned in the cavity and having an elongated conductor with a convex surface on each end and facing in opposing directions, and a spring member attached to the conductor between the ends thereof, said spring member including a strap and generally oval-shaped spring blades attached to said strap and extending away from opposite surfaces of the conductor, said spring blades including an attachment section with one end attached to said strap, an end section and a midsection intermediate the attachment and end sections, said contact unit disposed in the cavity with each convex surface forming a receptacle in cooperation with an adjacent wall which is perpendicular to the end walls, each receptacle being in alignment with a slot through which a tab may pass, and with the spring blades being biased against an adjacent wall to position and support the conductor in the cavity and to preload the convex surfaces against the adjacent walls so that upon insertion of tabs therebetween, wiping between the tabs and convex surfaces occurs.

10. The electrical connector of claim 9 wherein the attachment section is weakened to reduce its resistance to flexing.

11. The electrical connector of claim 10 wherein the spring blades provide a two-stage deflection with the first stage being a deflection of the attachment section and the second stage being a deflection of the midsection.

12. The electrical connector of claim 11 wherein the force required to deflect the attachment section is less than the force required to deflect the midsection.

13. The electrical connector of claim 9 wherein two contact units are positioned in the cavity in a side-by-side relation.

14. The electrical connector of claim 12 wherein two contact units are positioned in the cavity.

15. An electrical connector for electrically interconnecting tabs inserted thereinto from opposite sides, said connector comprising:

dielectric housing means having walls defining an enclosed cavity and with slots through each of two opposing side walls accessing said cavity, one of said slots being parallel to and adjacent a top wall of said housing means and the second slot being parallel to and adjacent a bottom wall of said housing means;

conductor means having a generally S-shape to define concavo-convex free ends, said conductor means pivotally disposed in said cavity with convex surfaces on said free ends facing respective top and bottom walls and defining in cooperation therewith first receptacle means in registration with a respective slot for receiving tabs inserted therethrough; and spring means having concavo-convex spring blades attached to and extending in opposite directions from an intermediate member, said intermediate member being attached to said conductor means with each spring blade adjacent a concave surface on said conductor means and with the convex surfaces on said spring blades being against respective top and bottom walls to position and support said conductor means in said cavity and for preloading said convex surfaces on said conductor means against respective top and bottom walls.

16. The electrical connector of claim 15 wherein said convex surfaces on said spring blades and respective top and bottom walls cooperate to define second receptacle means in registration with said first receptacle means to receive a tab inserted thereinto.

* * * * *